US005475478A

United States Patent [19]

Nishimura et al.

[11] Patent Number: 5,475,478

[45] Date of Patent: Dec. 12, 1995

[54] DEVELOPER UNIT AND METHOD OF SUPPLYING DEVELOPER

[75] Inventors: Soichiro Nishimura; Eiji Tanaka, both of Nagoya, Japan

[73] Assignee: Brother Kogyo Kabushiki Kaisha, Nagoya, Japan

[21] Appl. No.: 213,582

[22] Filed: Mar. 16, 1994

[30] Foreign Application Priority Data

Apr. 16, 1993 [JP] Japan ..... 5-089672

[51] Int. Cl.[6] ..... G03G 15/06; G03G 21/00

[52] U.S. Cl. ..... 355/260

[58] Field of Search ..... 355/200, 256, 355/260

[56] References Cited

U.S. PATENT DOCUMENTS

| | | | |
|---|---|---|---|
| 4,478,512 | 10/1984 | Zoltner | 355/260 |
| 4,963,938 | 10/1990 | Sonoda et al. | 355/260 |
| 5,028,961 | 7/1991 | DeCecco | 355/260 |
| 5,034,776 | 7/1991 | Sugiura | 355/260 |
| 5,121,165 | 6/1992 | Yoshida et al. | 355/260 |
| 5,177,540 | 1/1993 | Honda et al. | 355/260 |
| 5,325,163 | 6/1994 | Nishio | 355/260 |

*Primary Examiner*—Fred L. Braun
*Attorney, Agent, or Firm*—Oliff & Berridge

[57] ABSTRACT

A developing unit has an initial developer container containing an initial developer composed of toner and carrier, joined pivotally with a pin to a toner container having an initial developer inlet opening and defining a developing chamber. Provided in one wall of the developer container is an initial developer outlet opening. In an initial state, the initial developer outlet opening is closed by one wall of the toner container, so that the mixed toner contained in the initial developer container will not spill. When a toner supply cartridge is inserted in the developing unit, the toner supply cartridge turns the initial developer container downward on the pin to a position where the initial developer outlet opening of the initial developer container coincides with the initial developer inlet opening of the toner container. This allows the initial developer contained in the initial developer container to flow into the developing chamber. Thus, the initial developer can be supplied into the developing chamber by a simple action without soiling the operator's hands.

21 Claims, 5 Drawing Sheets

DEVELOPER UNIT AND METHOD OF SUPPLYING DEVELOPER

BACKGROUND OF THE INVENTION

1. Field of the Invention

The present invention relates to a processing unit to be incorporated into an electrophotographic apparatus such as a laser printer. More particularly, the invention relates to a developing unit to be incorporated into an electrophotographic apparatus.

2. Description of the Related Art

The conventional laser printer has a processing cartridge comprising a photoconductive member, a processing means including a charger, a developing unit and a cleaning unit, and a case containing the photoconductive member and the processing means. The processing cartridge is detachably mounted on the main frame of the laser printer. When the consumable component such as the photoconductive member needs to be replaced or the processing cartridge needs to be replenished with toner, the case containing the photoconductive member and the processing means is removed from the main frame of the laser printer. This processing cartridge is replaced with a new processing cartridge when the toner contained in the developing unit thereof is exhausted.

Replacing the used processing cartridge with a new processing cartridge instead of individually replacing the used consumable components of the used processing cartridge with new ones facilitates the replacement of the used consumable components and prevents making the operator's hands dirty, damaging the new consumable components and deteriorating picture quality. On the other hand, since the used processing cartridge is replaced with a new one when the toner of the used processing cartridge is exhausted, the photoconductive member and the charger of the used processing cartridge, which have a comparatively long service life and therefore are still serviceable, are discarded. This unnecessary waste increases the running cost of the laser printer and is not desirable from the view point of resources conservation and environmental protection.

A laser printer provided with a developing unit formed separately from other processing means and capable of operating at a comparatively low running cost has been proposed. In this laser printer, the developing unit is replenished with toner, and other processing means are not replaced when the toner contained in the developing unit is exhausted. This previously proposed laser printer provided with the developing unit that can be replenished with toner is described with reference to FIGS. 6A and 6B. The developing unit of the laser printer shown in FIGS. 6A and 6B is of a pseudo two-component toner system using a mixed developer prepared by mixing magnetic toner and magnetic carrier.

Referring to FIGS. 6A and 6B, a processing unit 80 consists of a developing unit 82 comprising a developing device 82A and a toner hopper 82B, and a processing subunit 84 comprising a photoconductive member 84A, a charger 84B and a cleaning device 84C. The developing unit 82 and the processing subunit 84 are contained in a case 86, and the case 86 is detachably mounted on the main frame 88 of a laser printer. The developing unit 82 and the processing subunit 84 can be individually removed from the case 86.

In case the laser printer is jammed, the case 86 containing the developing unit 82 and the processing subunit 84 is removed from the main frame 88 as shown in FIG. 6A. When the toner is exhausted, only the developing unit 82 is taken out from the case 86 without removing the case 86 from the main frame 88, and the empty toner hopper 82B is replaced with a new toner hopper containing toner to replenish the developing unit 82 with toner. When the photoconductive member needs to be replaced, the processing subunit 84 is taken out from the case 86 without removing the case 86 from the main frame 88, and then the used processing subunit 84 is replaced with a new one.

When the developing unit 82 is in an initial state, the developing unit 82 may be provided with a primary toner hopper containing initial developer containing carrier, and a secondary toner hopper containing replenishment toner. Either the primary toner hopper or the secondary toner hopper may be used as occasion demands. The developing device 82A may be charged with initial developer beforehand, or the developing device 82A may be provided with a sealed chamber filled with initial developer and the sealed chamber containing the initial developer may be unsealed when starting to use the developing unit 82 to supply the initial developer to the developing sleeve 90 of the developing device 82A.

The developing unit provided with both the primary toner hopper and the secondary toner hopper needs two toner hoppers respectively for containing the initial developer and the replenishment toner, which increases the manufacturing cost of the developing unit. Furthermore, there is the possibility that the operator may accidently use the primary toner hopper and the secondary toner hopper mistakenly.

The developing unit provided with the developing device charged beforehand with initial developer has the disadvantage that there is the possibility that the initial developer may spill from the developing device during the transportation of the developing unit. Thus, the developing device must be sealed with a special seal to prevent the initial developer from spilling from the developing device. Further, the operator's hands may be soiled when removing the seal.

Additionally, the developing unit provided with the developing device having the sealed chamber containing the initial developer has the disadvantage that there is the possibility that developer adhering to the seal removed from the developing device will soil the surroundings and the operator's hands.

SUMMARY OF THE INVENTION

Accordingly, it is an object of the present invention to provide a developing unit that enables the operator to set the initial developer by a single operation without soiling his or her hands.

The present invention provides a developing unit comprising a developing means for developing an electrostatic latent image to a visible image, a toner supply cartridge containing toner capable of being detachably incorporated into the developing means, a developer containing means containing a mixed developer including toner and carrier with a wall provided with a developer outlet opening and a toner container having a wall provided with a developer inlet opening. The developer containing means is moved relative to the toner container by joining the toner supply cartridge to the toner container from a first position where the developer outlet opening thereof is dislocated from the developer inlet opening of the toner container to a second position where the developer outlet opening thereof coincides with the developer inlet opening of the toner container. This allows the mixed developer contained in the developer containing means to flow into the toner container.

In this developing unit constructed according to the present invention, the developer containing means is moved from the first position, where the opening of the developer containing means and the inlet opening formed in the wall of the toner container are dislocated from each other, to the second position, where the outlet opening and the inlet opening coincide with each other. This movement occurs when the toner supply cartridge is inserted in the developing means to open a developer passage to enable the developer, including toner and carrier, to flow into the toner container from the developer containing means.

Therefore, the developer is supplied automatically from the developer containing means into the toner container. The developing unit can then be set in an operative state by a simple operation without soiling the operator's hands and the surroundings.

BRIEF DESCRIPTION OF THE DRAWINGS

The above and other objects, features and advantages of the present invention will become more apparent from the following description taken connection with the accompanying drawings, in which.

DETAILED DESCRIPTION OF PREFERRED EMBODIMENTS

Figure 1:
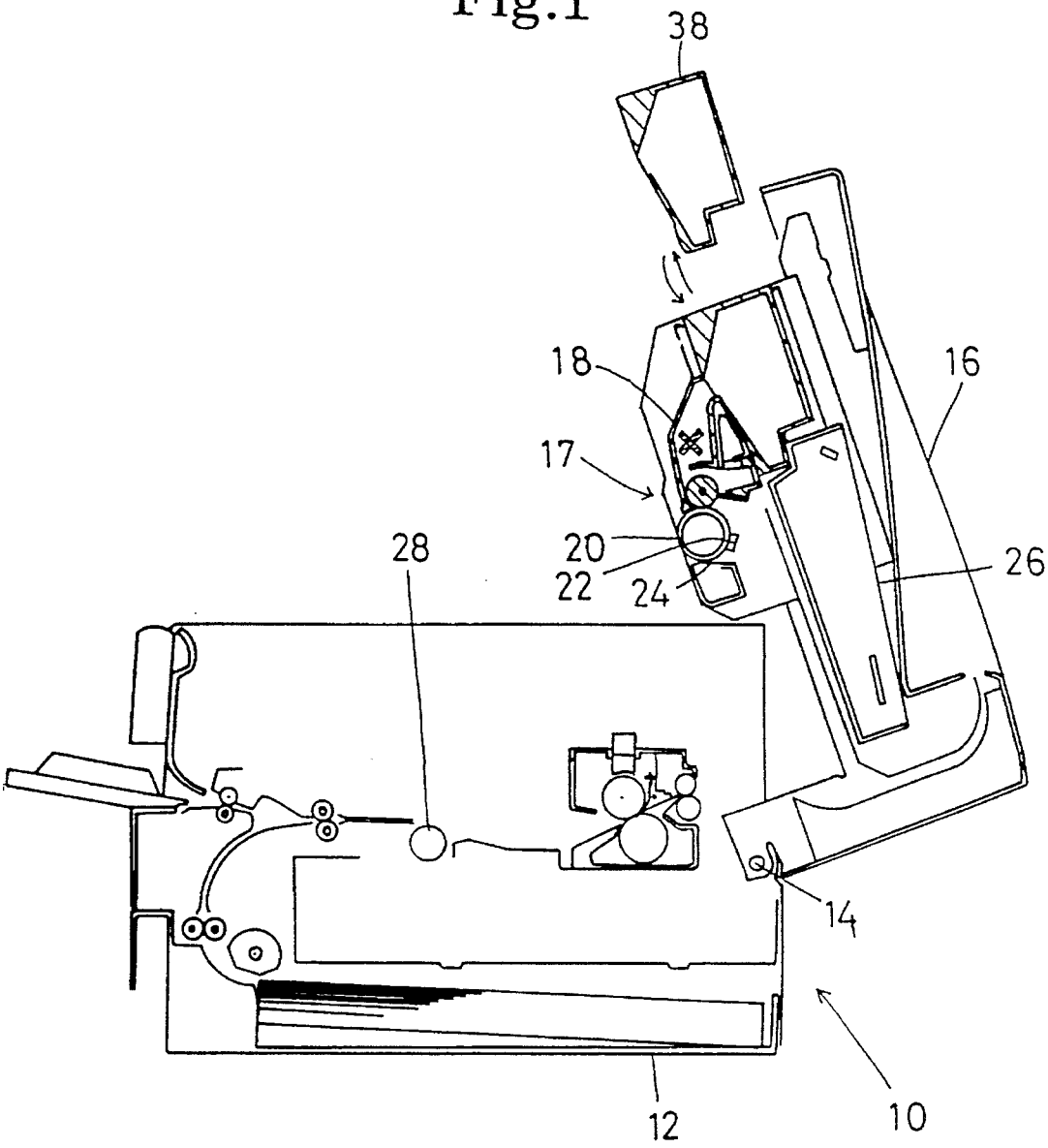
FIG. 1 is a side schematic sectional view of a laser printer employing a developing unit of the first embodiment.

As shown in FIG. 1, a laser printer 10 comprises a lower casing 12 containing a paper sheet cassette, a high-voltage power supply, a controller and other conventional elements. An upper casing 16 is pivotally connected to the lower casing 12 with a pin 14 so as to be rotated about the pin 14. A processing unit 17 is held on the upper casing 16. In the first embodiment, the processing unit 17 comprises a developing unit 18, a photoconductive drum 20, a charger 22 and a cleaning device 24, which can be individually removed from the processing unit 17. A scanning unit 26 is held on the upper casing 16.

When the upper casing 16 is closed, the charger 22, the scanning unit 26, the developing unit 18, a transfer unit 28 disposed in the lower casing 12, and the cleaning device 24 are arranged around the photoconductive drum 20 in that order with respect to the direction of rotation of the photoconductive drum 20.

Figure 2A:
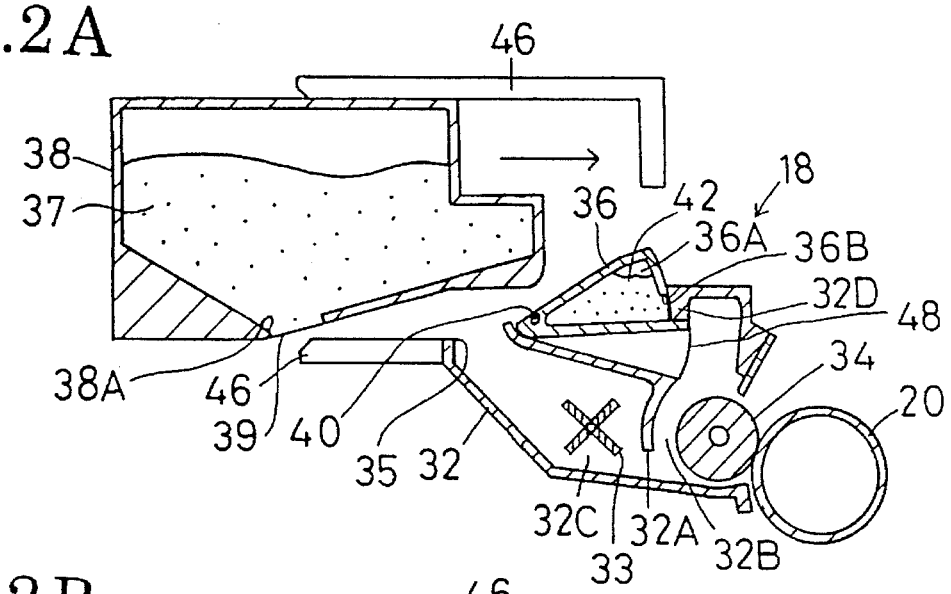
FIGS. 2A is a side sectional view showing a procedure for combining a toner hopper with and removing the same from a developing device included in the developing unit of FIG. 1.
Figure 2B:
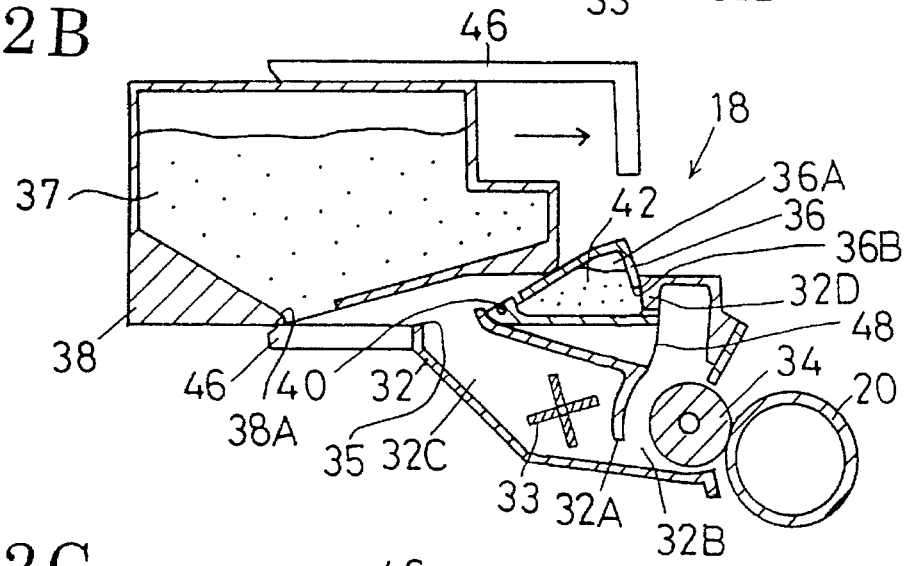
FIG. 2B is a side sectional view showing a procedure for combining a toner hopper with and removing the same from a developing device included in the developing unit of FIG. 1.
Figure 2C:
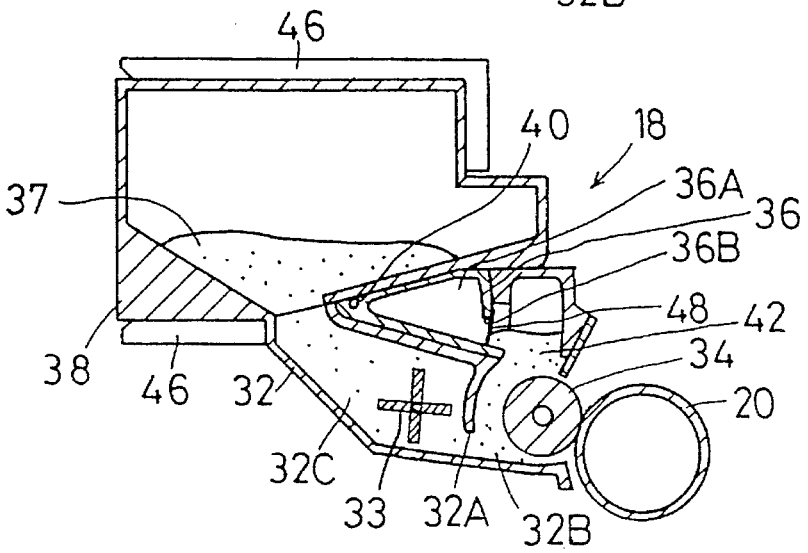
FIG. 2C is a side sectional view showing a procedure for combining a toner hopper with and removing the same from a developing device included in the developing unit of FIG. 1

The construction of the developing unit 18 of the first embodiment included in the processing unit 17 is described referring to FIGS. 2A, 2B and 2C.

The developing unit 18 comprises a toner container 32, a developing sleeve 34 disposed within the toner container 32, an initial developer container 36, and a toner supply cartridge 38 capable of being detachably joined to the toner container 32. The inner space of the toner container 32 is divided by a partition wall 32A into a carrier containment chamber 32B on the front side of the partition wall 32A containing the developing sleeve 34 and a toner reserving chamber 32C on the back side of the partition wall 32A. A rotary stirrer 33, which rotates to urge the toner toward the developing sleeve 34, is disposed within the toner reserving chamber 32C. The toner container 32 is fixed to the upper casing 16 of the laser printer 10 shown in FIG. 1. The opening 38A of the toner supply cartridge 38 is closed by a film 39.

The initial developer container 36 has an initial developer containing chamber 36A and an initial developer outlet opening 36B formed in a side wall thereof. The initial developer container 36 is joined pivotally to the toner container 32 with a pin 40. As shown in FIG. 2A, in an initial state in which the developing unit 18 has not yet been used, an initial developer 42 containing carrier is stored in the initial developer containing chamber 36A of the initial developer container 36, and the initial developer outlet opening 36B is closed by a wall 32D of the toner container 32 so that the initial developer 42 will not spill. The initial developer container 36 is provided with a valve element at the initial developer outlet opening 36B to prevent the reverse flow of the initial developer 42 supplied into the carrier containment chamber 32B from the carrier containment chamber 32B into the initial developer container 36. The upper casing 16 is provided with upper and lower guide members 46 to guide the toner supply cartridge 38 for movement. The toner container 32 is provided with an initial developer inlet opening 48 through which to receive the initial developer 42 into the carrier containment chamber 32B from the initial developer container 36.

Next, the printing operation of the laser printer 10 is explained. First, a procedure for setting the developing unit 18 in an operative state is briefly described referring to FIGS. 2A, 2B and 2C.

The initial developer container 36 is biased upward and pressed against the wall 32D of the toner container that acts as a stopper, in a state shown in FIG. 2A by a spring (not shown) located on the pin 40 before the toner supply cartridge 38 is inserted in the upper casing 16. The toner supply cartridge 38 is inserted in the upper casing 16 and is moved along the upper and lower guide members 46 in the direction of the arrow to push the initial developer container 36. Consequently, the initial developer container 36 is turned downward on the pin 40, as shown in FIG. 2B.

Finally, the toner supply cartridge 38 is set in place on the upper casing 16 as shown in FIG. 2C. In the state shown in FIG. 2C, the initial developer container 36 is positioned at its lowest position and locked in place with a locking member (not shown), provided on the toner container 32. The initial developer outlet opening 36B of the initial developer container 36 coincides with the initial developer inlet opening 48 of the toner container 32 to allow the initial developer 42 to flow from the initial developer container 36 into the carrier containment chamber 32B of the toner container 32 and to fall on the developing sleeve 34. The toner outlet opening 38A of the toner supply cartridge 38 coincides with the toner inlet opening 35 of the toner container 32. In the state shown in FIG. 2C, the valve element prevents the reverse flow of the initial developer 36 from the carrier containment chamber 32B into the initial developer container 36. After the toner supply cartridge 38 has been thus set in place, a film 39 closing the toner outlet opening 38A is pulled out in a direction perpendicular to the direction of insertion of the toner supply cartridge 38 in the upper casing 16 to supply the toner 37 from the toner supply cartridge 38 into the toner container 32.

After the toner supply cartridge 38 has been thus set in place on the upper casing 16 relative to the toner container 32, the laser printer 10 becomes operative. A host computer sends printing data to the laser printer 10, and then the charger charges the circumference of the photoconductive drum 20 uniformly according to the printing data. The scanning unit 26 scans the circumference of the photoconductive drum 20 with light for exposure to record image information in an electrostatic latent image on the circumference of the photoconductive drum 20. Subsequently, the developing unit 18 develops the electrostatic latent image in a visible toner image, and then the transfer unit 28 transfers the toner image from the photoconductive drum 20 to a recording sheet to print the toner image on the recording sheet. The residual toner remaining on the circumference of the photoconductive drum 20 after the toner image has been transferred to the recording sheet is removed from the circumference of the photoconductive drum 20 by the cleaning device 24 to complete one printing cycle. Then, the circumference of the photoconductive drum 20 is charged uniformly again by the charger 22 for the next printing cycle. The printing cycle is repeated to print toner images successively on recording sheets.

As the printing cycle is repeated, the toner contained in the toner supply cartridge 38 is consumed, and the toner supply cartridge 38 needs to be replaced before the toner is completely exhausted. When replacing the almost exhausted toner supply cartridge 38, the toner supply cartridge 38 is moved in a direction opposite to the direction of the arrow indicated in FIG. 2A. Since the initial developer container 36 is locked at the lowest position with the locking member, the initial developer container 36 remains at the lowest position after the toner supply cartridge 38 has been removed, so that the toner will not spill.

The carrier content of the initial developer 42 contained beforehand in the initial developer container 36 is dependent on the volume of the carrier containment chamber 32B in a state where the toner supply cartridge 38 is set in place on the upper casing 16. The carrier content of the initial developer 42 is in the range of 50% to 80% in a state where the carrier containment chamber 32B is filled up with the initial developer 42.

The developing unit 18 is free from problems in supplying carrier in the initial state of a developing unit that uses a mixed developer prepared by mixing carrier and toner. Since the developing unit 18 need not be provided with two toner supply cartridges respectively for containing initial developer and replenishment toner, there is no possibility that one of the two hoppers is mistakenly used for the other, which is possible to occur with a developing unit provided with two toner hoppers.

The spill of initial developer from the developing unit during transportation, which occurs inevitably in a developing unit storing initial developer beforehand in the space surrounding the developing sleeve, is prevented, and any special sealing member for sealing the initial developer is not necessary. Since the developing unit 18 is not provided with any sealing member to be pulled out before starting to use the developing unit 18, the operator's hands and clothes are not soiled and the surroundings will not be contaminated. Since the initial developer is supplied automatically into the carrier containment chamber 32B upon the insertion of the toner supply cartridge 38 in the upper casing 16, the supply of both the initial developer and the toner can be accomplished by a single action.

Figure 3:
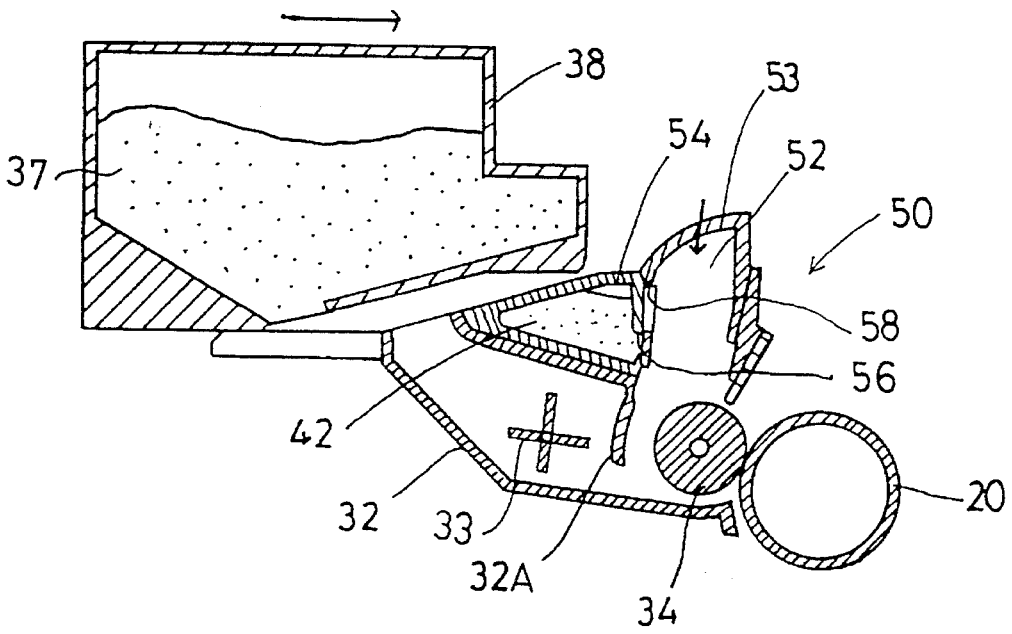
FIG. 3 is a side sectional view of a developing unit of the second embodiment.

Referring to FIG. 3, a developing unit 50 of the second embodiment has a cover member 53 covering a developer containment chamber 52 and is provided with an initial developer inlet opening 58. An initial developer container 54 is provided with an initial developer outlet opening 56. When a toner supply cartridge 38 is inserted in the developing unit 50, the cover member 53 is depressed by the toner supply cartridge 38 so that the initial developer inlet opening 58 of the cover member 53 coincides with the initial developer outlet opening 56 of the initial developer container 54 to allow the initial developer 42 contained in the initial developer container 54 to flow into the developer containment chamber 52.

Figure 4:
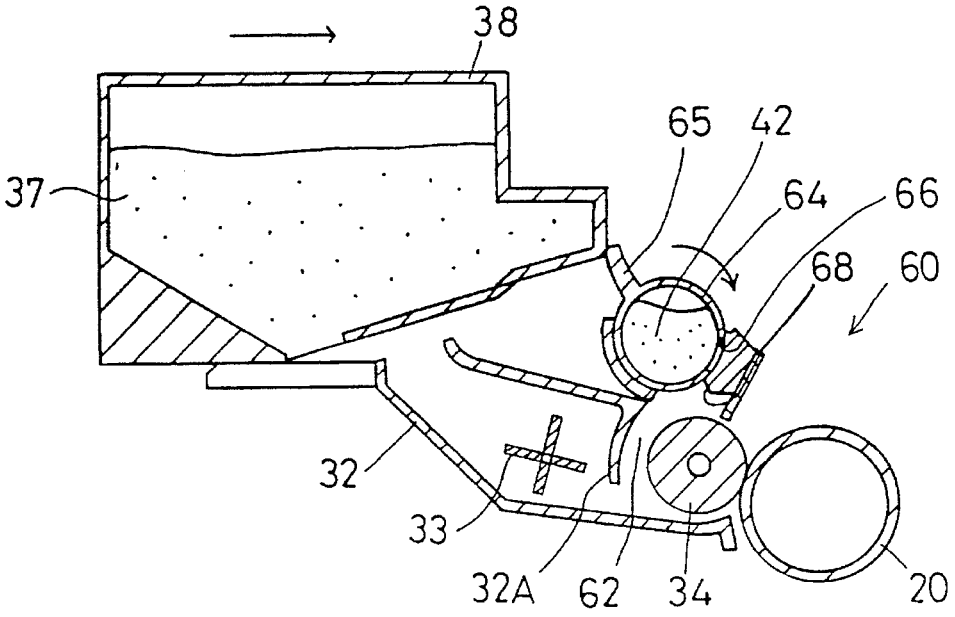
FIG. 4 is a side sectional view of a developing unit of the third embodiment.

Referring to FIG. 4, a developing unit 60 of the third embodiment has a cylindrical initial developer container 64 disposed on top of a developer containment chamber 62 provided with an initial developer inlet opening 68, a lug 65 and an initial developer outlet opening 66. When a toner supply cartridge 38 is inserted in the developing unit 60, the toner supply cartridge 38 pushes the initial developer container 64 at the lug 65 to turn the initial developer container 64 in the direction of the arrow so that the initial developer outlet opening 66 of the initial developer container 64 coincides with the initial developer inlet opening 68 to allow the initial developer 42 contained in the initial developer container 64 to flow into the developer containment chamber 62.

Figure 5:
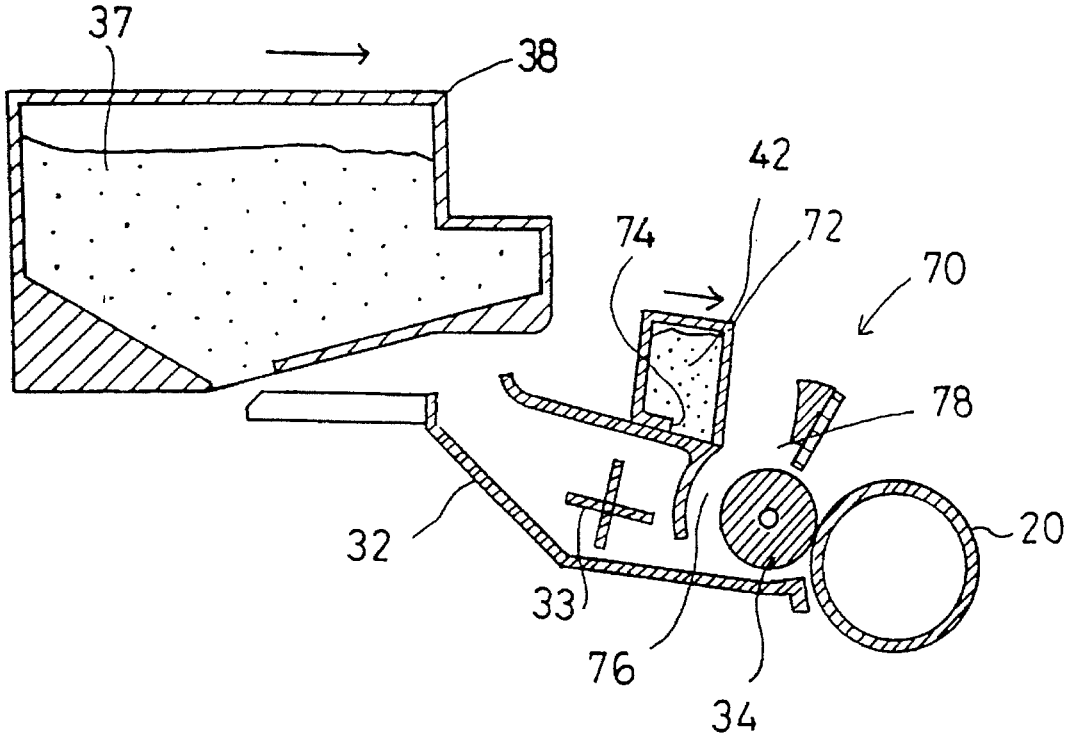
FIG. 5 is a side sectional view of a developing unit of the fourth embodiment.
Figure 6A:
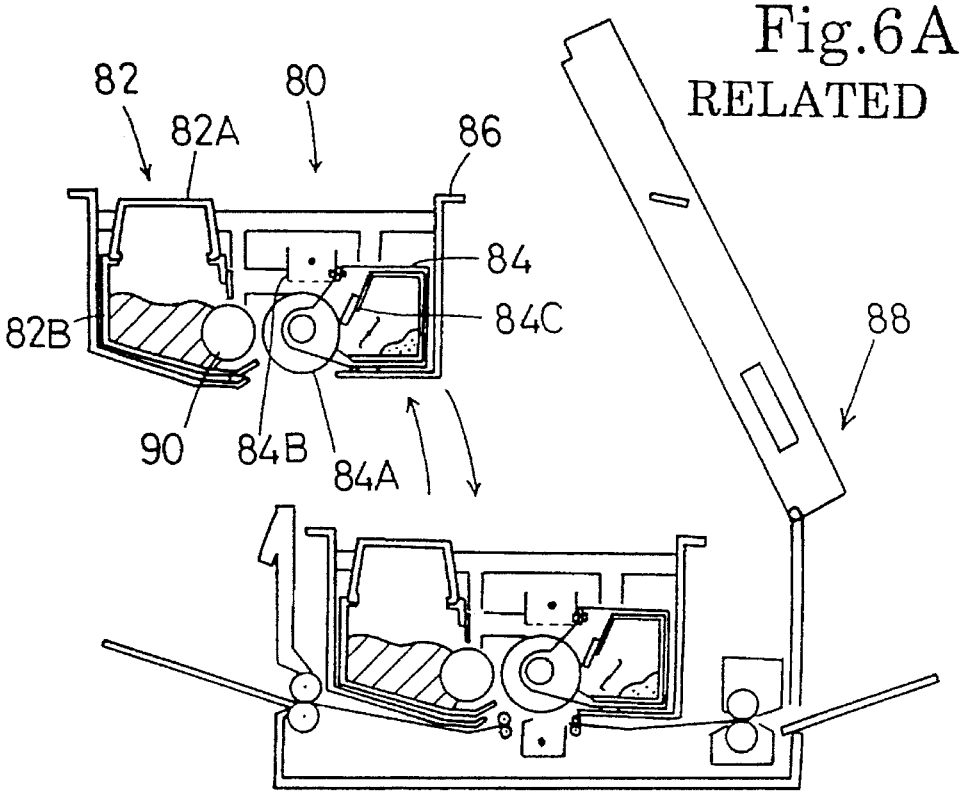
Fig.6A RELATED ART
FIG. 6A is a schematic side sectional view showing a procedure for installing/removing a processing unit in/from a laser printer of the related art.
Figure 6B:
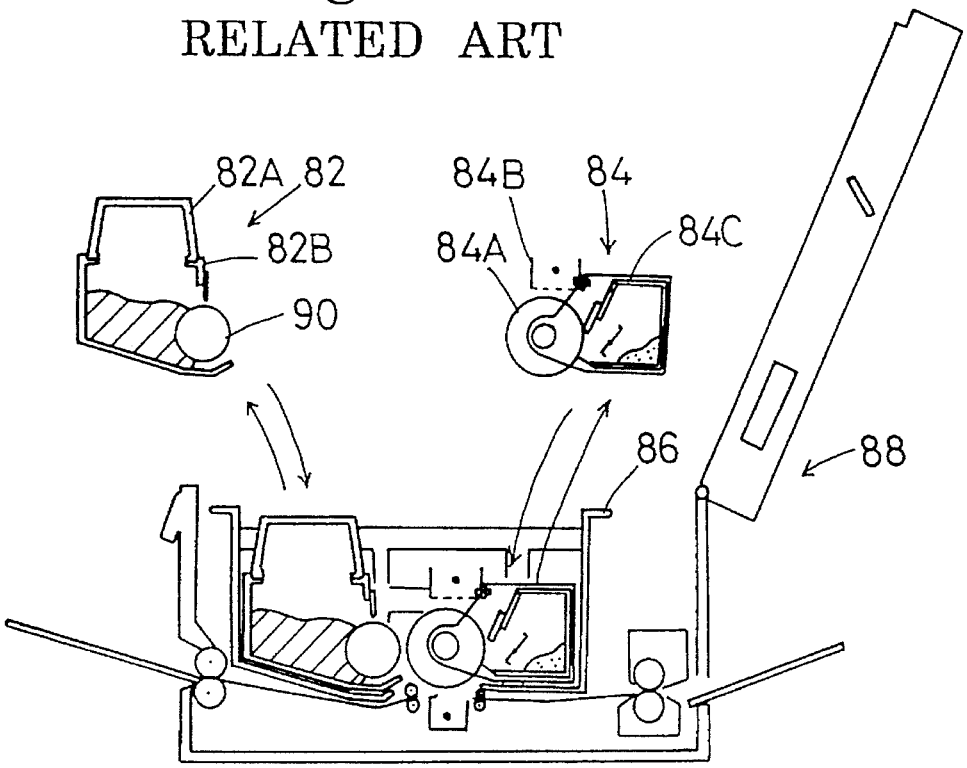
Fig.6B RELATED ART
FIG. 6B is a schematic side showing a procedure for individually installing/removing a developing unit and a processing subunit included in the processing unit of FIG. 6A in/from the laser printer.

Referring to FIG. 5, a developing unit 70 of the fourth embodiment has an initial developer container 72 provided with an initial developer outlet opening 74. A developer containment chamber 76 is provided with an initial developer inlet opening 78. When a toner supply cartridge 38 is inserted in the developing unit 70, the toner supply cartridge 38 pushes the initial developer container 72 to make the initial developer container 72 slide in the direction of the arrow so that the initial developer outlet opening 74 of the initial developer container 72 coincides with the initial developer inlet opening 78 of the developer containment chamber 76 to allow the initial developer 42 contained in the initial developer container 72 to flow into the developer containment chamber 76.

Although the photoconductive drum, the charger and the cleaning device are detachably and individually held on the upper casing in the foregoing embodiments, a processing cartridge integrally comprising a photoconductive drum, a charger and a cleaning device may be detachably held on the upper casing in a modification.

The scanning unit employed in the foregoing embodiments as an exposure means may be substituted by another exposure means such as an LED array.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A developing unit comprising:

developing means for developing an electrostatic latent image into a visible image;

a toner container adjacent to said developing means having a wall with a developer inlet opening;

a detachable toner supply cartridge containing toner and detachably coupled to said toner container; and developer containing means for supplying developer to said toner container containing a mixed developer including toner and carrier and having a wall with a developer outlet opening, wherein said developer containing means and said toner container are relatively movable when said toner supply cartridge is coupled to said toner container from a first position where said developer outlet opening is closed to a second position where said developer outlet opening coincides with said developer inlet opening to allow the mixed developer in said developer containing means to flow into said toner container.

2. The developing unit of claim 1 wherein said developer outlet opening faces said wall of said toner container in the first position.

3. The developing unit of claim 1 wherein said developer containing means is pivotally coupled to said toner container with said developer outlet opening facing said wall of said toner container in the first position and said developer outlet opening aligned with said developer inlet opening in the second position.

4. The developing unit of claim 3 wherein said developer containing means is biased outwardly from said toner container in the first position and said toner supply cartridge forces said developer containing means to pivot toward said developer inlet opening in the second position.

5. The developing unit of claim 1 wherein said toner container comprises a movable cover extending outwardly from said toner container and said developer inlet opening is formed in said cover, wherein said toner supply cartridge forces said cover to move and said developer inlet opening to align with said developer outlet opening in the second position.

6. The developing unit of claim 1 wherein said developer containing means is a rotatable cylinder with a lug extending therefrom and said toner supply cartridge abuts said lug and forces said developer containing means to rotate and said developer outlet opening to align with said developer inlet opening.

7. The developing unit of claim 1 wherein said developer containing means comprises a container slidably coupled to said toner container adjacent to said developer inlet opening, wherein said developer containing means interferes with said toner supply cartridge and said toner supply cartridge pushes said developer containing means over said developer inlet opening to align with said developer outlet opening in the second position.

8. An image forming apparatus with a lower casing and an upper casing pivotally coupled to the lower casing, wherein the upper casing comprises a developing unit comprising:

a toner container with a developing sleeve coupled adjacent thereto and having a developer inlet and a toner supply inlet;

a developer container coupled to the toner container and having a developer outlet; and a toner supply cartridge detachably installed on the toner container and having a toner supply outlet capable of communicating with the toner supply inlet, the developer container and at least a portion of the toner container being relatively movable to each other from an initial position to an operating position as the supply cartridge is installed on the toner container;

wherein the developer outlet is sealed in the initial position, and the developer outlet and the developer inlet are aligned and in communication in the operating position.

9. The image forming apparatus of claim 8 wherein the developer outlet faces an outer wall of the toner container in the initial position.

10. The image forming apparatus of claim 8 wherein the developer container is pivotally coupled to the toner container with the developer outlet facing the toner container in the initial position and the developer outlet aligned with the developer inlet in the operating position.

11. The image forming apparatus of claim 10 wherein the developer container is biased outwardly from the toner container in the initial position and the toner supply cartridge forces the developer container to pivot toward the developer inlet in the operating position.

12. The image forming apparatus of claim 8 wherein the toner container comprises a movable cover extending outwardly from the toner container and the developer inlet is formed in the cover, wherein the toner supply cartridge forces the cover to move and the developer inlet to align with the developer outlet in the operating position.

13. The image forming apparatus of claim 8 wherein the developer container is a rotatable cylinder with a lug extending therefrom and the toner supply cartridge abuts the lug and forces the developer container to rotate and the developer outlet to align with the developer inlet.

14. The image forming apparatus of claim 8 wherein the developer container is slidably coupled to the toner container adjacent to the developer inlet, wherein the developer container interferes with the toner supply cartridge and the toner supply cartridge pushes the developer container over the developer inlet to align with the developer outlet in the operating position.

15. An image forming apparatus according to claim 8, wherein the toner supply cartridge contacts the developer container to move the developer container to the operating position.

16. A method of selectively supplying developer from a developer container to a toner container in a developing device with a detachable toner supply cartridge comprising the steps of:

coupling the developer container onto the toner container with an outlet in the developer container facing a wall of the toner container; and installing the detachable toner supply cartridge to the toner container to move the developer container relative to the toner container to align the outlet of the developer container with an inlet of the toner container.

17. The method of claim 16 wherein the step of moving the developer container relative to the toner container comprises pivoting the developer container.

18. The method of claim 16 wherein the step of moving the developer container relative to the toner container comprises rotating the developer container.

19. The method of claim 16 wherein the step of moving the developer container relative to the toner container comprises sliding the developer container.

20. The method of claim 16 wherein the step of moving the developer container relative to the toner container comprises sliding a cover portion of the toner container.

21. A method according to claim 16, wherein the step of installing the detachable toner supply cartridge further includes the step of contacting the developer container with the detachable toner supply cartridge to align the outlet of the developer container with an inlet of the toner container.

* * * * *